United States Patent [19]

Palmer et al.

[11] Patent Number: 4,516,395

[45] Date of Patent: May 14, 1985

[54] METALLIC CABLE FOR REINFORCING ELASTOMERIC ARTICLES

[75] Inventors: Kenneth J. Palmer, Wadsworth; Dennis R. Brandyberry, Canton; Grover W. Rye, Cuyahoga Falls, all of Ohio

[73] Assignee: The Goodyear Tire & Rubber Company, Akron, Ohio

[21] Appl. No.: 525,540

[22] Filed: Aug. 23, 1983

[51] Int. Cl.[3] ..... D02G 3/48

[52] U.S. Cl. ..... 57/237; 57/211; 57/236; 57/902

[58] Field of Search ..... 57/212, 211, 213, 236, 57/906, 237, 210, 902, 3, 228; 245/1.5; 174/126 R, 128 R, 128 BL

[56] References Cited

U.S. PATENT DOCUMENTS

| | | | |
|---|---|---|---|
| 1,271,824 | 7/1918 | Anderegg et al. | 174/128 R X |
| 1,312,872 | 8/1919 | Rettinger | 57/213 |
| 1,726,551 | 9/1929 | Ford | 174/34 |
| 1,860,498 | 5/1932 | Ford | 174/34 |
| 2,317,910 | 4/1943 | Hill | 57/211 X |
| 3,158,984 | 12/1964 | Butler | 57/210 |
| 3,336,744 | 8/1967 | Peene | 57/212 X |
| 3,358,435 | 12/1967 | Peene | 57/902 X |
| 3,555,789 | 1/1971 | Terragna | 57/906 X |
| 3,600,884 | 8/1971 | Yazawa et al. | 57/902 X |
| 3,690,056 | 9/1972 | Peters | 57/237 |
| 3,847,190 | 11/1974 | Forester | 57/3 X |
| 4,176,513 | 12/1979 | Young et al. | 57/237 |
| 4,399,853 | 8/1983 | Morimoto et al. | 57/228 X |
| 4,408,444 | 10/1983 | Baillievier | 57/237 |

FOREIGN PATENT DOCUMENTS

| | | |
|---|---|---|
| 478055 | 6/1929 | Fed. Rep. of Germany . |
| 3014190 | 10/1980 | Fed. Rep. of Germany . |
| 49-47416 | 12/1974 | Japan . |
| 8102273 | 12/1982 | Netherlands . |
| 2098251 | 11/1982 | United Kingdom . |

*Primary Examiner*—John Petrakes

*Attorney, Agent, or Firm*—L. R. Drayer

[57] ABSTRACT

A metallic cable for reinforcing elastomeric articles comprises two strands of two filaments twisted together and having a cable lay length. The filaments of each strand are twisted together and the strands have strand lay lengths that are equal to one another but different from the cable lay length. The direction of twist of the strands may be either the same as, or opposite to the direction of twist of the cable.

6 Claims, 13 Drawing Figures

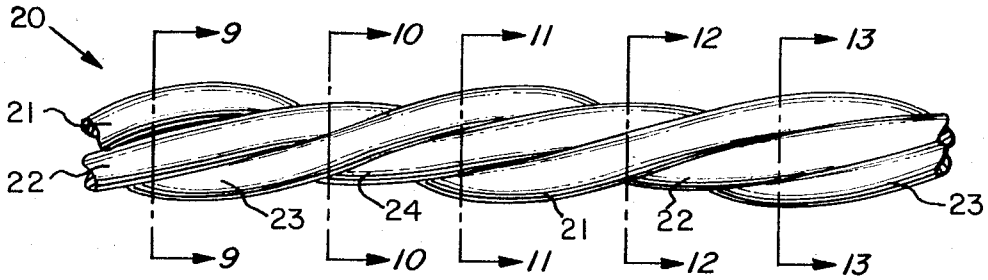
FIG. 8
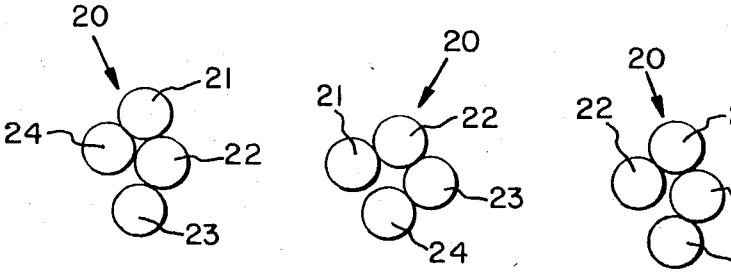
FIG. 9
FIG. 10
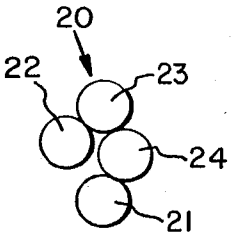
FIG. 11
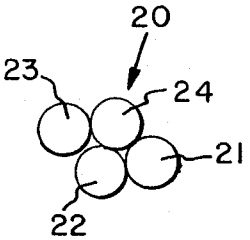
FIG. 12
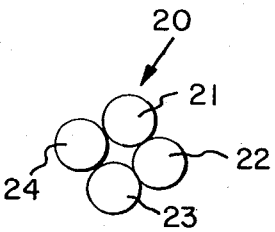
FIG. 13

METALLIC CABLE FOR REINFORCING ELASTOMERIC ARTICLES

BACKGROUND OF THE INVENTION

This invention relates generally to metallic cables, and more particularly to metallic cables that are useful for reinforcing elastomeric articles such as tires, hoses and belts.

One of the problems that may be encountered in elastomeric articles that are reinforced with metallic cables is the propogation of corrosion along the length of the cable in the event that the article is cut or torn so that the cable is exposed. One approach to solving the problem of corrosion propogation has been to make the cable very compact, so that there are no interstices between the filaments and strands comprising the cable, therefore leaving no natural pathway along which corrosion may travel. A second approach has been to make the cable with a very open construction, such that the elastomeric material in which the cable is embedded can penetrate the cable and substantially surround each individual filament. The present invention is concerned with the latter approach.

BRIEF DESCRIPTION OF THE DRAWING

The invention will be better understood by referring to the figures of the drawing, wherein:

FIG. 8 is a side elevational view of a cable made in accordance with another embodiment of the invention; and FIGS. 9 to 13 are cross-sectional views taken along lines 9—9 to 13—13, respectively, of FIG. 8.

DETAILED DESCRIPTION OF THE INVENTION

Figure 1:
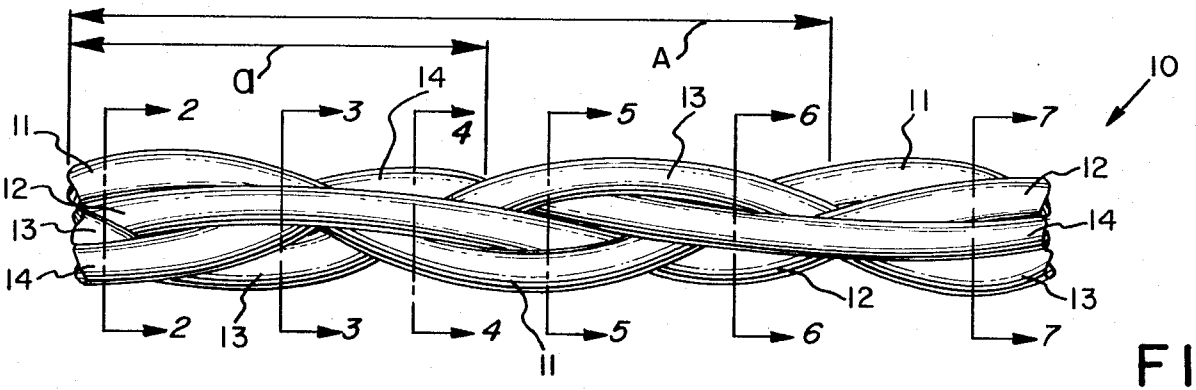
FIG. 1 is a side elevation view of a cable made in accordance with one embodiment of the invention.
Figure 7:
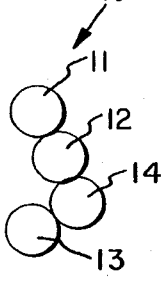
FIGS. 2 to 7 are cross-sectional views taken along lines 2—2 to 7—7, respectively, of FIG. 1.
Figure 6:
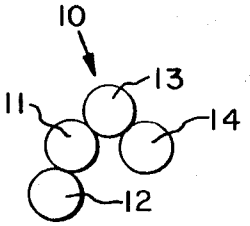
Figure 5:
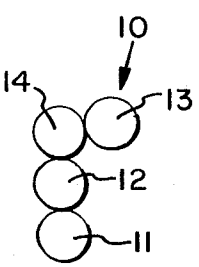
Figure 4:
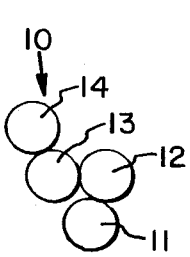
Figure 3:
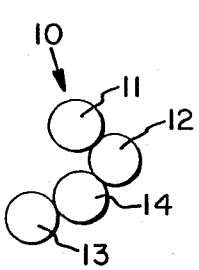
Figure 2:
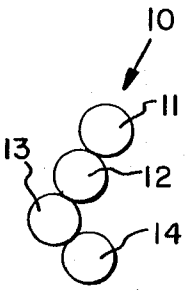

Referring first to FIG. 1, there is shown a side elevational view of a metallic cable 10 made in accordance with the preferred embodiment of the invention. The cable 10 comprises two strands of two wires twisted together and having a cable lay length "A". Each strand comprises two filaments, 11,12 and 13,14 respectively, twisted together such that the strands each have the same strand lay length "a". The strand lay length of the strands differs from the cable lay length, such that the strand lay length is either greater than or less than the cable lay length by between 25% and 75%. More preferably the strand lay length differs from the cable lay length by between 40% and 60%, and most preferably the strand lay length differs from the cable lay length by 50%. The differential between the strand lay length and the cable lay length is critical because if the differential is too small or too large the filaments will nest together too closely resulting in a more compact structure that will not allow an elastomeric material to flow around and substantially surround each filament.

As used herein a "filament" refers to an individual metallic wire; a "strand" refers to a group of filaments combined together to form a unit; and a "cable" refers to a structure comprising two or more strands.

In the preferred embodiment illustrated in FIG. 1, the filaments comprising each of the strands are twisted together in a direction that is opposite to the direction that the strands are twisted together to form the cable.

Preferably all of the filaments 11,12,13,14 comprising the strands have the same diameter.

As used herein, the direction of twist or lay refers to the direction of slope of the spirals of a strands or filament when the cable is held vertically. If the slope of the spirals conform in direction to the slope of the letter "S", then the twist is called "S" or "left-hand". If the slope of the spirals conform to the slope of the letter "Z", then the twist is called "Z" or "right-hand". "Lay length" is the axial distance required for a filament or strand to make one 360 degree revolution in a strand or cable.

Referring now to FIG. 8, there is shown a side elevational view of a cable made in accordance with another embodiment of the invention. The cable 20 shown in FIG. 8 is similar to the cable shown in FIG. 1, with the only difference being that the filaments 21,22,23,24 comprising each of the strands are twisted together in the same direction that the strands are twisted together to form the cable.

FIGS. 2 through 7 are cross-sectional views taken along lines 2—2 to 7—7, respectively, of FIG. 1; and FIGS. 9 through 13 are cross-sectional views taken along lines 9—9 to 13—13, respectively, of FIG. 8. The open structure of cables made in accordance with the invention may be seen in these cross-sectional views. This open structure allows each filament to be substantially surrounded by an elastomeric substance in which the cable is embedded by an appropriate process, such as calendering. Surrounding the individual filaments with an elastomeric substance not only helps to restrict the spread of corrosion, it also helps to prevent the filaments from wearing against each other and restricts the amount of heat generated when the cable is subjected to bending loads. For example, these advantages may be realized by using cables according to the invention to reinforce an elastomeric article such as a pneumatic tire, a hose, or a belt.

While certain representative embodiments and details have been shown for the purpose of illustrating the invention, it will be apparent to those skilled in the art that various changes and modifications may be made therein without departing from the spirit or scope of the invention.

What is claimed is:

1. A metallic cable for reinforcing elastomeric articles comprising two strands twisted together and having a cable lay length, each of said strands comprising two filaments twisted together and said strands each having a strand lay length, the strand lay length of said strands being equal to one another but being less than said cable lay length by between 25% and 75%.

2. A metallic cable according to claim 1 wherein the filaments comprising each of said strands are twisted together in a direction that is opposite to the direction that said strands are twisted together.

3. A metallic cable according to claim 1 wherein the filaments comprising each of said strands are twisted together in the same direction that said strands are twisted together.

4. A metallic cable according to any of claims 1, 2 or 3 wherein said strand lay length is less than said cable lay length by between 40% and 60%.

5. A metallic cable according to claim 4 wherein all of the filaments comprising said strands have the same diameter.

6. A metallic cable according to any of claims 1, 2 or 3 wherein all of the filaments comprising said strands have the same diameter.

* * * * *